US005730556A

United States Patent [19]

Barley

[11] Patent Number: 5,730,556

[45] Date of Patent: Mar. 24, 1998

[54] REMOVABLE GROUND ANCHOR

[75] Inventor: Anthony Donald Barley, Harrogate, Great Britain

[73] Assignee: Keller Limited, Great Britain

[21] Appl. No.: 547,673

[22] Filed: Oct. 17, 1995

Related U.S. Application Data

[63] Continuation of Ser. No. 84,514, Jun. 29, 1993.

[30] Foreign Application Priority Data

Jul. 1, 1992 [GB] United Kingdom ..... 9214006

[51] Int. Cl.[6] ..... E02D 5/80

[52] U.S. Cl. ..... 405/259.5; 52/166; 405/262

[58] Field of Search ..... 52/166, 146, 148, 52/152, 223.4, 223.5, 223.12, 650.1, 651.01, 651.07, 652.1, 653.2; 405/284, 286, 262, 259.5, 259.6

[56] References Cited

U.S. PATENT DOCUMENTS

| | | | |
|---|---|---|---|
| 379,217 | 3/1888 | Green | 52/223.12 |
| 637,420 | 11/1899 | Robbins | 52/651.01 |
| 3,650,112 | 3/1972 | Howlett et al. | 405/259.5 |
| 4,503,645 | 3/1985 | Nudd et al. | 52/651.01 |
| 4,514,113 | 4/1985 | Neumann | 405/262 |

FOREIGN PATENT DOCUMENTS

| | | | |
|---|---|---|---|
| 58-65819 | 4/1983 | Japan | 405/262 |
| 58-80022 | 5/1983 | Japan | 405/262 |
| 64-1824 | 1/1989 | Japan | 405/262 |

*Primary Examiner*—Michael Safavi
*Attorney, Agent, or Firm*—MacMillan, Sobanski & Todd

[57] ABSTRACT

A ground anchor assembly comprises a looped cable 3 passing around a saddle 4 with one or more optional recesses 8 in its outer surface 7, all this being held in place by solidified grout or the like in an elongate bore 1. Extension 5 gives good transfer of forces when both cable ends are stressed outwards, and tubes 6 prevent internal cracking of the grout. After a period of use the cable 3 can be removed by pulling one cable end only.

More than one such cable 3 can pass round saddle 4, and more than one such assembly can locate in the bore 1.

12 Claims, 2 Drawing Sheets

REMOVABLE GROUND ANCHOR

Figure 1:
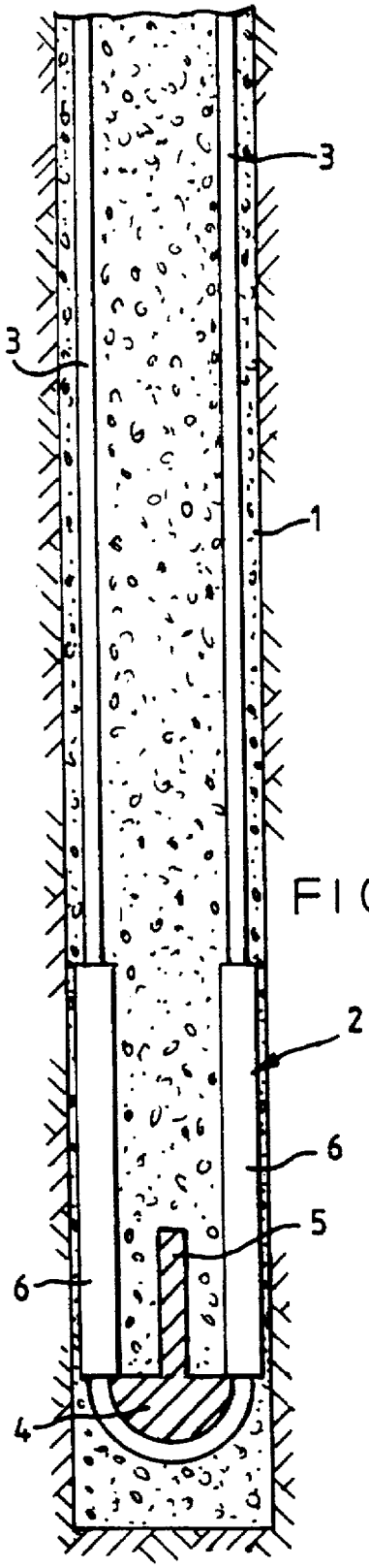

This application is a continuation of copending application Ser. No. 08/084,514 filed on Jun. 29, 1993.

This invention relates to ground anchors, and more particularly to ground anchor assemblies from which the anchor cable may be removed after use.

It is commonplace in the construction of deep foundations of large civil engineering structures to anchor a temporary earth retaining wall against lateral movement at least, by means of cables themselves held within elongate bores in the surrounding ground. There are many conventional way of effecting this in detail. By and large they involve the bonding of the inner end of the cable(s) into a cementitious or resin grout in the bore so that there is resistance to pullout movement of the cable.

Occasionally it is appropriate to leave the cable and anchor in place, but frequently they are temporary expedients and where possible should be removed when the structure is complete and self-supporting.

It is of course possible to remove only the projecting cables by cutting the cable at the top end of the elongate bore, so that there is no surface projection, and thus leave a proportion of the cable in the bore. However, since the bores in question are sometimes up to 20 or 40 meters in length, it can happen that they pass beyond the boundaries of the property upon which the construction is taking place and into the ground beneath adjacent properties. The abandoned components of such ground anchors may be detrimental to subsequent work on the adjacent site. In particular, while the bore itself and the solidified anchor grout is of no particular importance, and while any minor fastening elements, of discrete nature and relatively small size, can be readily removed from subsequent excavations, the existence of a length of high tensile cable stretching across a site to be developed, at some distance under the ground, is undesirable and it is frequently stipulated that any such cables must be removed on completion of adjacent building construction.

The present invention is concerned with an assembly for a ground anchor from which assembly the anchor cable can be removed after the desired period of use.

In one aspect the invention consists in a ground anchor assembly held within an elongate bore by a solidified retaining material and comprising at least one cable protruding from the bore and a retention member within the bore acting in use to retain the cable, characterised in the retention member is a saddle member, around which the or each cable is looped, held in the bore by the grout so as to resist movement of the or each cable when both respective ends of such cable are pulled but permit extraction of the or each cable when one end only thereof is pulled.

The solidified retaining material is typically a grout, as described below. Possibly it could be a resinous material. For ease of description the term 'grout' is used below, as describing the more usual expedient.

The ground anchor assembly saddle member may possess an integral portion or attached member extending along the bore. Moreover, tubular members may surround any cable at those lengths thereof nearest the saddle.

The arcuate surface of the saddle member may be grooved or recessed to accept the cable, or more than one cable.

If desired a bore may be provided with more than one such assembly at different distances along the bore.

Figure 2:
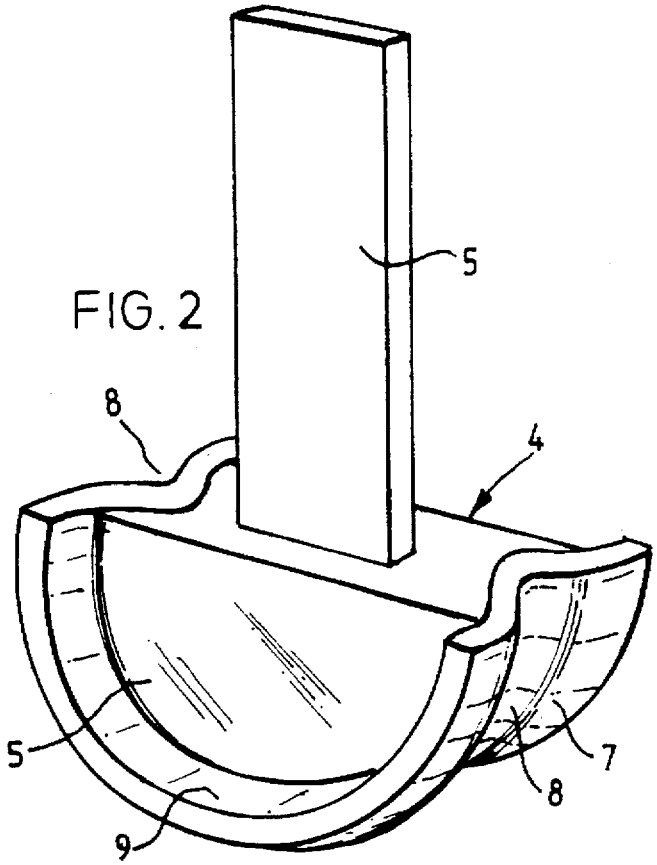
Figure 3:
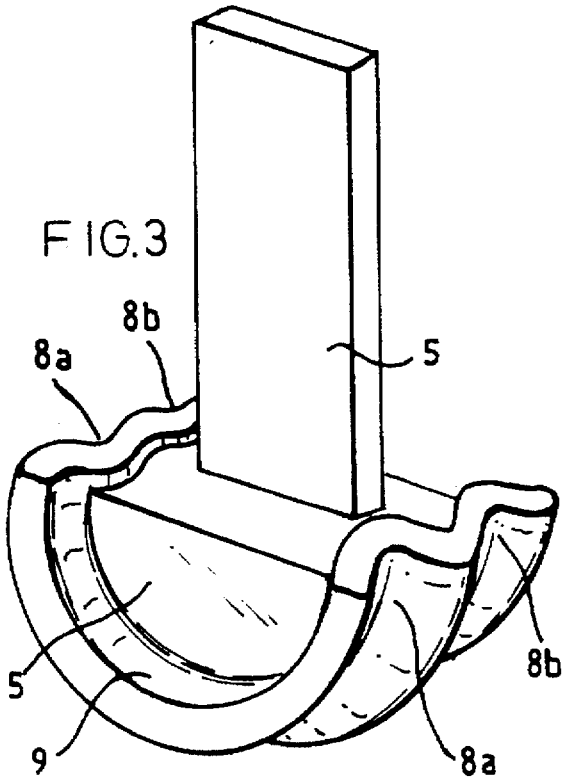
Figure 4:
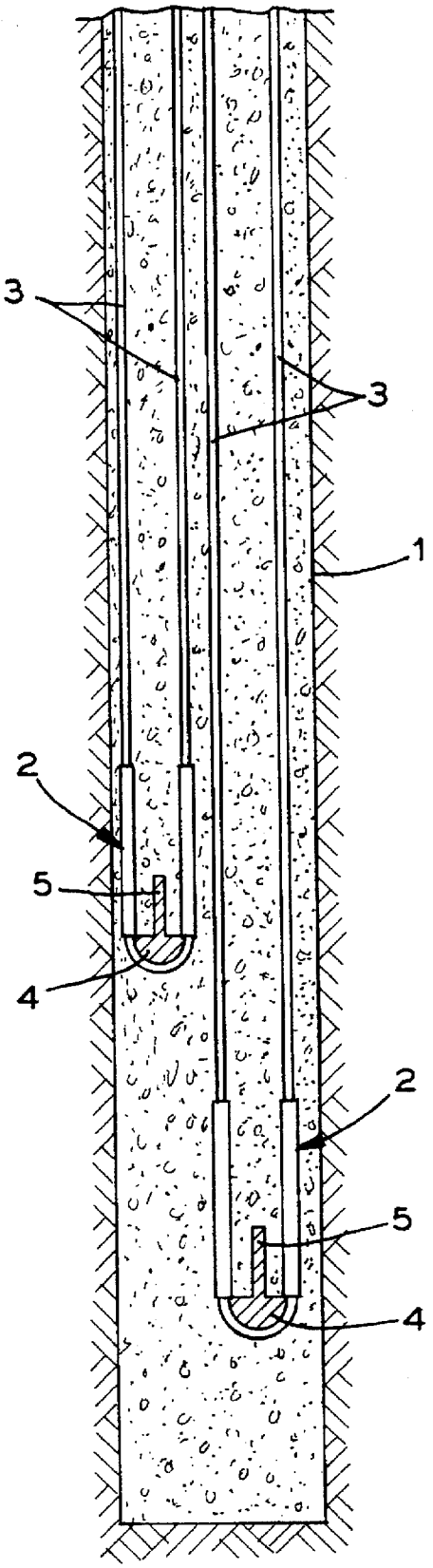

The invention will be further described with reference to the accompanying drawings, in which:

FIG. 1 is a longitudinal medial section of a bore equipped with a removable ground anchor assembly in accordance with one embodiment of the present invention, FIG. 2 shows in perspective, and on an enlarged scale, a saddle member as utilized in the assembly of FIG. 1, FIG. 3 shows a like saddle member adapted to receive more than one such cable, and FIG. 4 shows a longitudinal medial section of a ground bore having a removable anchor formed with a plurality of saddle members and cables.

FIG. 1 shows an elongate bore 1 in which is emplaced a removable ground anchor assembly 2 itself comprising a length of cable 3; a saddle member 4, about which the cable is looped, extending generally across the bore; a longitudinal extension 5 to the saddle member; and rigid tubular members 6 surrounding the cable 3 at its regions nearest the saddle member.

In use the whole assembly is held in the elongate bore 1 by a solidified body of grout G which has been pumped into the bore as a liquid slurry and allowed to set and harden.

FIG. 2 shows a form of saddle member 4 in more detail. As shown it possesses a saddle outer surface 7 grooved or recessed at 8 to accept and locate the cable loop. One such loop is shown, but more than one cable could be looped about the saddle. The inner saddle surface 9 lies largely transverse to the axis of the bore. To it is fixed a suitable extension 5, to transfer stresses exerted on the saddle 4.

FIG. 3 shows a suitable saddle for use with more than one cable (in the example shown, two cables) in recesses 8*a*, 8*b*, other references being as for FIG. 2.

FIG. 4 shows the elongate bore 1 in which a plurality of ground anchor assemblies 2 are secured with a solidified grout. Each ground anchor assembly 2 includes a saddle member 4 about which one or more cables 3 are looped. The cables 3 extend from a top of the bore 1.

The device is installed and used as follows:

1. A suitable elongate bore 1, perhaps up to 20 or 40 meters in length, is drilled through the retaining ground, usually at an inclined angle.

2. A length of pre-bent cable 3 looped generally at its middle portion around the groove or recess 8 in saddle 4 is lea into the bore. More than one such length can be so positioned if desired, either using a saddle as in FIG. 3 or by using two or more saddles as in FIG. 2.

Optionally the or each cable is greased, and may therefore be sheathed to cover such grease. Optionally moreover the or each cable is provided with rigid tubular members 6, for reasons disclosed below, where indicated and optionally at other more remote locations from the saddle, also as discussed in more detail below.

The exact nature of the saddle 4 can be varied provided it allows arcuate positioning of the more or less central portion of the cable 3, (or plurality of cables) and that it extends partially across the bore. It is preferred but not absolutely essential to provide the recess 8 (or recesses 8*a*, 8*b*) for locating the cable or cables. The extension 5, extending upwards from the saddle to some extent, is also an optional but preferred feature.

3. Grout, which is a slurry comprising settable cementitious material with water, is pumped into the bore so as to fill the bore and surround the or each cable 3 and saddle 4.

If desired the grout at this stage may be pumped only to cover the tubular members 6. In such a case a second assembly, with single or multiple cables; can be inserted in the bore above this first grout level. If such a second or subsequent such assembly is so located, further tubes 6 may be located about the cable 3 at regions where they pass an upper saddle.

4. The grout is allowed to set and harden.

5. The two cable ends of the cable or of each of any plurality of cables used, are stressed simultaneously to the desired extent to act as an anchor.

The function of extension 5 is to give good transfer of that resistant force provided within the grouted bore via the or each cable for restraining the earth retaining wall and allowing construction of the foundations. There is a tendency of the grout to crack in the region of the cable due to strain arising from the loading of the ground anchor. The grout compresses the cable. This can happen especially when the cable is sheathed to protect grease on the cable and thus possesses some internal minor voids or compressible spaces. The rigid tube 6 resists this compression and resists the tendency of the grout to crack. Also if and where the cable portions of a lower saddle pass through grout placed under strain by an upper saddle, there is a similar compression problem and thus reinforcement tubes such as tube 6 can be positioned on the cables at these relatively high positions.

6. When it is desired to move the anchor cable one end of the cable (or of said cables) is pulled and the other end is released. The cable moves longitudinally in relation to the grout and the loop or each loop, passes around the saddle surface so that it can be withdrawn, leaving only the bore hole full of grout and the minor discrete metal members such as the saddle 4 and its extension 5, and the metal tubes 6.

I claim:

1. A ground anchor assembly adapted to be held within an elongate bore by a solidified retaining material comprising: a saddle member having a first surface which is adapted to abut the retaining material to hold the saddle member in the bore and a second surface, a pair of rigid tubular members disposed adjacent to said first surface of said saddle member, each of said tubular members having an end abutting said first surface of said saddle member, and a cable having a pair of ends adapted to extend out of the bore, said cable extending through one of said rigid tubular members, over said second surface of said saddle members and through the other of said rigid tubular members so as to resist movement of said cable when both of said ends thereof are pulled while permitting extraction of said cable when only one of said ends thereof is pulled.

2. A ground anchor assembly, as claimed in claim 1, and wherein said saddle member has an arcuate surface and at least one recess in said arcuate surface for accepting and locating said cable.

3. A ground anchor assembly, as claimed in claim 1, and wherein said saddle member includes an elongated member extending from said first surface and adapted to transfer load to solidified retaining material when said ground anchor is held in a bore by solidified retaining material.

4. A ground anchor assembly, as claimed in claim 2, and wherein said saddle member has a plurality of recesses in said arcuate surface for accepting and locating a plurality of cables.

5. A ground anchor assembly adapted to be held within an elongate bore by a solidified retaining material comprising: a plurality of saddle members adapted to be spaced at different distances along the bore, each saddle member having a first surface which is adapted to abut the retaining material to hold such saddle member in the bore and a second surface, a pair of rigid tubular members for each saddle member disposed adjacent to the first surface of an adjacent saddle member, each of said tubular members having an end abutting said first surface of an adjacent saddle member, and a separate cable for each saddle member having a pair of ends adapted to extend out of the bore, each cable extending through one of said rigid tubular members in a pair, over said second surface of the adjacent saddle member and through the other of said rigid tubular members in the pair so as to resist movement of said cable when both of said ends thereof are pulled while permitting extraction of said cable when only one of said ends thereof is pulled.

6. A ground anchor assembly, as claimed in claim 5, and wherein each saddle member has an arcuate surface and at least one recess in said arcuate surface for accepting and locating a cable.

7. A ground anchor assembly, as claimed in claim 4, and wherein each of said saddle members have an elongated member extending from a first surface and adapted to transfer load to solidified retaining material when said ground anchor is held in a bore by solidified retaining material.

8. A ground anchor assembly, as claimed in claim 5, and wherein each saddle member has a plurality of recesses in said arcuate surface for accepting and locating a plurality of cables.

9. A ground anchor assembly adapted to be held within an elongate bore by a solidified retaining material for releasably anchoring a cable loop when located in the bore while two cable ends which extend from the bore are pulled, said ground anchor assembly comprising: a saddle member having a first surface which is adapted to abut the retaining material to hold the saddle member in the bore and an arcuate second surface, and a pair of rigid tubular members disposed adjacent to said first surface of said saddle member, each of said tubular members having an end abutting said first surface of said saddle member, said ground anchor being adapted to retain a cable extending through one of said rigid tubular members, over said second surface of said saddle members and through the other of said rigid tubular members so as to resist movement of said cable when both of said ends thereof are pulled while permitting extraction of said cable when only one of said ends thereof is pulled.

10. A ground anchor assembly, as claimed in claim 9, and wherein said saddle member has at least one recess in said arcuate surface for accepting and locating a cable.

11. A ground anchor assembly, as claimed in claim 9, and wherein said saddle member has an elongated member extending from said first surface and adapted to abut the retaining material to hold said saddle member in the bore.

12. A ground anchor assembly, as claimed in claim 10, and wherein said saddle member has a plurality of recesses in said arcuate surface for accepting and locating a plurality of cables.

* * * * *